United States Patent [19]

Lieptz

[11] Patent Number: 4,468,994

[45] Date of Patent: Sep. 4, 1984

[54] KEY CUTTING DEVICE

[75] Inventor: Nathan S. Lieptz, Beachwood, Ohio

[73] Assignee: Congoleum Corporation, Portsmouth, N.H.

[21] Appl. No.: 310,232

[22] PCT Filed: Sep. 3, 1981

[86] PCT No.: PCT/US81/01183

§ 371 Date: Sep. 3, 1981

§ 102(e) Date: Sep. 3, 1981

[87] PCT Pub. No.: WO83/00835

PCT Pub. Date: Mar. 17, 1983

[51] Int. Cl.³ ..... B26D 5/10

[52] U.S. Cl. ..... 83/414; 30/131; 83/693; 83/917

[58] Field of Search ..... 83/412, 414, 415, 395, 83/525, 529, 530, 636, 688, 693, 917, 622; 30/124, 131; 76/110; 409/304

[56] References Cited

U.S. PATENT DOCUMENTS 3,180,196 4/1965 Coulon et al. ..... 83/693

3,496,636 2/1970 Lieptz ..... 30/131 X 3,633,451 11/1972 Lieptz ..... 30/131 X

FOREIGN PATENT DOCUMENTS 67328 8/1948 Denmark ..... 83/688

305937 5/1918 Fed. Rep. of Germany ..... 83/688

*Primary Examiner*—William R. Briggs

*Assistant Examiner*—Lawrence Meier

*Attorney, Agent, or Firm*—Isler and Ornstein

[57] ABSTRACT

A key cutting device (20), for replacement keys, having a key blank support member (30), a lever-actuated shearing punch (25) for the key blank, and a depth-gauging stop (33) for the support member (30); the shearing punch (25) is formed to provide an optional two-step (44, 46) cut on the key with a control stop (49) for limiting the stroke of the punch to one step or two steps, as desired, for creating different cuts on the key blank; a locking device (63) automatically moves into locking position with respect to the yieldably-actuated support member (30) to prevent its displacement when the operating lever (37) is manipulated for the key cutting operation.

13 Claims, 14 Drawing Figures

KEY CUTTING DEVICE

TECHNICAL FIELD

In the field of key cutting machines, there are basically two distinct varieties for the purpose of cutting replacement keys. One of these varieties is broadly denominated as a "duplicator" which utilizes an existing cut key as a pattern for reproducing the same sequence of cuts on a suitable key blank. The other variety of key cutting machine can be broadly denominated as a "code cutter" which does not require an existing cut key as a pattern, but instead utilizes a key or lock number and coded key cuts information to establish settings on the machine which will provide the desired sequence of cuts on a suitable key blank. Both varieties can either be manually or power operated.

The present invention relates to the code cutting type of device.

BACKGROUND ART

In my prior U.S. Pat. No. 3,496,636 granted Feb. 24, 1970, entitled "KEY CUTTING MACHINE WITH PRESELECTED DEPTH GAUGING" and in my prior U.S. Pat. No. 3,633,451 granted Jan. 11, 1972, entitled "KEY CUTTING MACHINE WITH COORDINATED POSITIONING AND CUTTING MOVEMENTS", there are disclosed improved forms of code cutters which utilize a "readout" form of preselected depth gauging by means of which the entire code sequence of cuts for the key blank can be preset on the machine before any cuts are made.

With the advent of and trend toward lighter weight automobiles, the automobile manufacturers have progressively reduced the thickness of automobile doors so that the available space for the lock assembly for the doors has been considerably reduced. The lock manufacturers have accordingly found it necessary to reduce the length of the lock cartridge or mechanism. Correspondingly, the keys for these locks have been reduced in length and the customary uniform spacing between adjacent cuts on the key have also been reduced. As a consequence, the cuts on existing keys are often shallower than has been standard practice in the art, and the first cut on many keys is so close to the shoulder of the key that a cut of less than standard width has to be made, otherwise the shoulder itself would be eliminated by the cut. Inasmuch as the shoulder of the key is necessary to precisely limit the extent of insertion of the key in the lock for proper operation, any mutilation or cutting away of the shoulder of the key must be avoided. Furthermore, in making replacement keys, the shoulder serves as the reference point for the cuts to be made on the key, so it is necessary that the shoulder not be damaged during the course of the cutting operation on a replacement key.

In addition to the above-mentioned changes which have occurred in automotive locks and keys, there has also been a strong impetus toward improving the security of automotive locks and keys to prevent theft. This has resulted, for example, in double-edged keys and corresponding locks, as well as an increase in the number of tumblers or wafers with a corresponding increase in the number of cuts on the key. In the past, automotive keys ordinarily had five or six cuts. Presently, there are automotive keys that have as many as twelve cuts compressed into the same space which formerly accommodated five or six cuts.

The cutting of the original key by the automotive lock manufacturer poses no particular problem because the manufacturer can utilize specialized, high production key cutting tools and equipment for the mass production of the original keys. However, when replacement keys are required, automobile dealers and locksmiths do not have such single purpose equipment for key cutting, particularly code key cutting, and must utilize code key cutters of the type described in the foregoing patents and use interchangeable accessories to accommodate to different key cutting situations.

Thus, in the type of key cutting circumstance mentioned above, a locksmith attempting to use a code cutter to replace a lost key, would have to replace the standard cutting punch of the code cutter with a smaller punch to make the first cut on the key without damage to the shoulder of the key. After the first cut, the punch would have to be replaced again with a standard punch to finish the remaining cuts on the key. This involves considerable time and work for the locksmith.

It has also been found that with the increased number of cuts on a key balnk and with the advent of double-edge keys, a much greater degree of precision is required in making replacement keys. Heretofore, when only five or six cuts were required in an automotive replacement key, some slight inaccuracies could be tolerated without affecting the operabiity of the key in the lock. Such inaccuracies could result from normal wear on the cutting punch or other elements of the code key cutting device. Such inaccuracies also could result from a weakening of the spring linkage between the key blank support member and the operating lever of the apparatus of the type disclosed in my above-mentioned patents. Such a weakening of spring tension sometimes permits the key blank support member to be displaced slightly during the key cutting process, as the spring may no longer be sufficiently strong to retain the support member in the desired cutting depth position. Dullness of the cutting punch could also create a force vector tending to displace the support member in opposition to its spring tension. Such minor inaccuracies cumulate and compounded by increasing the number of cuts on the key, and therefore often produce a replacement key which does not operate properly.

In order to avoid the problem associated with making the first cut on the key blank with a different sized cutting punch than is used for the remainder of the cuts, some locksmiths have resorted to ordering key blanks from the manufacturer which have the first cut already provided therein. This procedure requires the locksmith to maintain a large inventory of a variety of precut, first cut key blanks of different depths and shapes in order to render prompt service to replacement key customers. Furthermore, the possibility of inaccuracies in the remaining standard cuts on the key blank still exists, even when a pre-cut key blank is used for the first cut.

The present invention is directed to overcoming both of the foregoing problems by improvements on key cutting devices of the type disclosed in the foregoing patents.

DISCLOSURE OF INVENTION

It is a primary object of the invention to overcome the above-described prior art problems by means of an improved code cutter type of key cutting machine which utilizes a two-step key cutting punch with selective control of the extent of cutting stroke of the punch.

Another object of the invention is to overcome the above-mentioned problems of the prior art key cutting devices by providing a code key cutter having locking means automatically responsive to actuation of the cutting punch for locking the key blank support member against punch-induced displacement from its preselected depth-of-cut position.

An additional object of the invention is to provide a two-step shearing punch of the type described which will effect an initially greater shearing pressure per unit area on the key blank than would be effected with the same punch actuating force if only a single step cutting action of the punch were utilized.

BEST MODE FOR CARRYING OUT THE INVENTION

Figure 1:
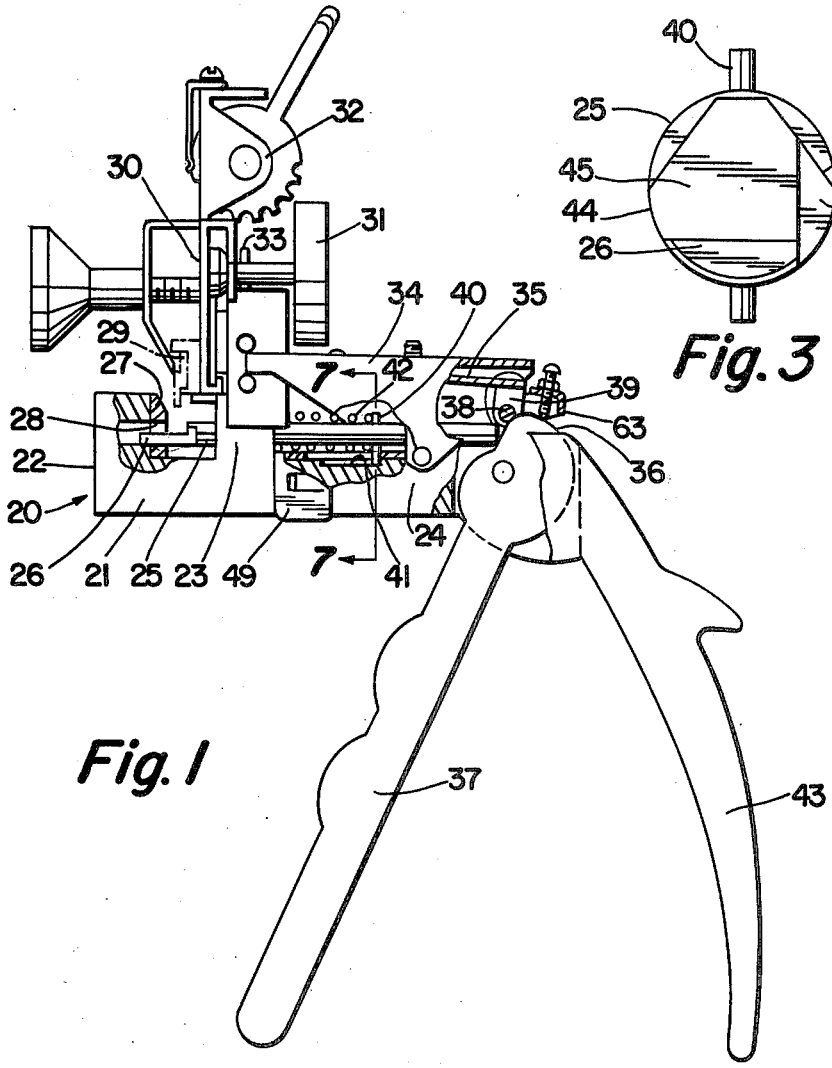
FIG. 1 is a side elevation of a code key cutting device embodying the features of my invention, with portions thereof broken away to more clearly show details of the structure.
Figure 3:
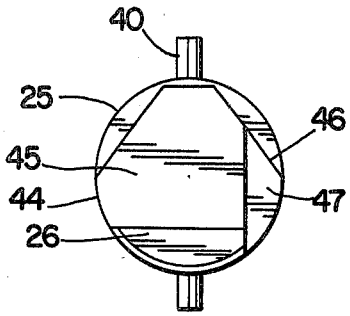
FIG. 3 is an end view of the punch, taken as indicated by lines 3—3 on FIG. 2.
Figure 2:
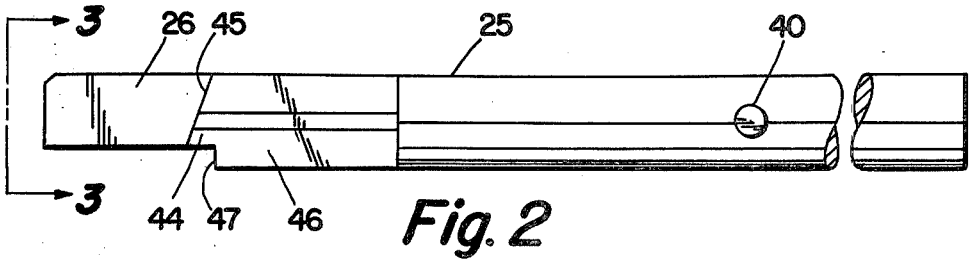
FIG. 2 is an enlarged top plan view of the novel punch of my invention.
Figure 4:
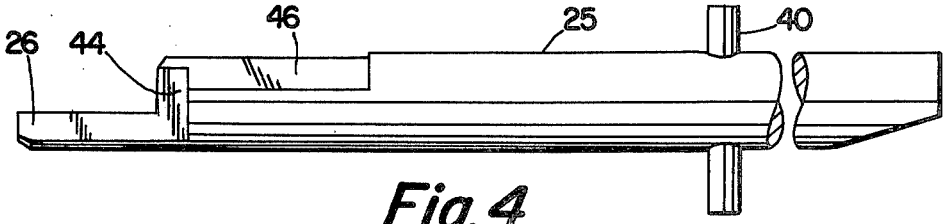
FIG. 4 is a side elevation of the punch shown in FIG. 2.

Referring more particularly to FIG. 1 of the drawing, there is shown a modified form of the key cutting machine which has heretofore been fully described and illustrated in my above-mentioned U.S. Pat. No. 3,633,451.For that reason, the present description of the prior art structure shown will be abbreviated and reference made to said U.S. Pat. No. 3,633,451 for a full description of the details of this form of prior art key cutting device.

For purposes of discussing the inventive improvements hereinafter disclosed, the following brief description of this key cutting device will suffice.

The key cutting device or machine 20 includes a sturdy body 21 having longitudinally spaced upstanding portions 22, 23 and 24. A key blank cutting tool in the form of a longitudinally-extending cylindrical shearing punch 25 slidably traverses the portions 23 and 24 and has a tongue or guide portion 26 which projects into the forward upstanding portion 22. A hardened anvil piece 27 is mounted on the inward face of the portion 22 and is provided with an opening 28 which conforms to the cross-sectional configuration of the punch 25.

A conventional key blank 29, as used for the making of a replacement key, is suitably clamped or secured in a support member, generally indicated as 30. The support member can be manipulated by geared knob 31 to move the key blank from side to side to various indexed positions for sequential cuts. The support member is also vertically movable on the upstanding portion 23 to position it for a selected depth of cut. For this purpose, the support member is provided with an adjustable notched depth gauge assembly 32 which can be manipulated to predetermine and preselect the depth of cut on the key blank at its different index positions of traversal. A depth-gauging abutment or stop 33 is fixed to the upstanding portion 23 to limit the downward movement of the support member by engagement of the stop with a selected notch in the depth gauge assembly 32.

A pivotally mounted saddle element 34 has one end thereof operatively connected to the support member 30. A stiff cantilever spring 35 has one end thereof affixed to the saddle element 34 and has its opposite free end yieldably engaging the camming surface 36 of the operating handle or lever 37 which is pivotally secured to the body 21. When the lever handle is retracted, it cams the free end of the cantilever spring 35 upwardly on one side of the saddle element, so as to cause the fixed end of the spring 35 to urge the opposite end of the saddle element downwardly and bring the support member downwardly therewith until the depth gauge stop 33 arrests its further downward movement. Continued rotation of the lever handle 37 and its action on the free end of the cantilever spring 35 is taken up by the resilient displacement of the spring 35, thus creating a lost motion connection with the support member which does not result in any further downward movement thereof. In order to reduce friction between the free end of the sping 35 and the surface 36 of the lever handle, a roller pin 38 is mounted through the spaced ears 39 on the free end of the spring to bear against the upper portion of the lever handle.

The punch 25 is provided with a circumferential projection in the form of a diametrically projecting pin 40 whose lower portion travels in a guide slot 41 which is provided in the body 21. This prevents angular rotation of the punch during its movements. The pin 40 also serves as the seat for a coil spring 42 which surrounds a portion of the punch 25 and bears against the face of the portion 23 to cause retraction of the punch when the lever handle 37 is released.

To operate the described device, the lever handle 37 is drawn toward the hand grip portion 43 to cam the end of the punch 25 and displace it forwardly in opposition to the coil spring 42. At this time, the key blank 29 has already been laterally positioned by manipulation of the knob 31 for the first cut. The elements of the depth gauge assembly have also been severally positioned for the various depths of cut required. As the punch is actuated forwardly, the camming surface 36 of the hand lever elevates the cantilever spring 35, which through the linkage of the saddle element 34, resiliently urges the support member 30 downwardly into abutment with the depth-gauge stop 33. The tongue or guide portion 26 of the punch is always in the anvil opening 28, so that the punch is properly guided in its advance movement, until its cutting surface engages and penetrates the key blank 29 for the predetermined cut.

The lever handle 37 is then released and the coil spring 42 returns the handle and punch to their original positions, while at the same time the tension on the cantilever spring is relieved and the support member 30 is returned to its elevated position.

The knob 31 is again manipulated to index the key blank support member 30 to the second cut position and the key cutting operation is repeated. This cycle of operation continues until all the desired cuts are made. The manual force applied to the hand lever 37 is transmitted, in a force-compounding action, to the punch which, in turn, translates this force into a pressure per unit area for shearing the desired portion of the key blank.

It will be noted that, due to the resilient lost motion connection between the cantilever spring 35 and the key blank support member 30, the support member is not locked or secured against displacement from the stop 33 during the cutting operation. Due to the various factors mentioned previously, there are circumstances in which such undesired upward displacement of the support member 30 can and will occur. Furthermore, if the punch is dull or if the key blank is made of hard metal, a considerably greater force must be applied to the lever handle 37 to accomplish the key cutting action, because the conventional punch provides a single cutting surface which is utilized in a one-step cutting operation for each cut on the key blank.

The foregoing briefly describes the basic elements and the method of operation of the key cutting machine disclosed in U.S. Pat. No. 3,633,451.

Referring now more particularly to FIGS. 2–6 of the drawing, details of the improved punch are illustrated. The punch 25 is provided rearwardly of the tongue 26 with a first step cutting portion 44 having a predetermined area of cutting surface 45. This first cutting portion is smaller in cross-sectional area than the cutting area of a standard or conventional key cutting punch, as hereinafter more fully explained. Slightly rearward of the first cutting portion 44, is a second step cutting portion 46 having a cutting surface area 47. It will be understood that the actual cutting area utilized in the cutting operation on the key blank will depend upon the depth of cut being made at any particular lateral index position of the key blank, so that these cutting surface areas have to be considered in terms of maximum areas for the deepest possible cut, even though less than the maximum cutting areas will frequently be utilized for shallower cuts. However, whether the cutting surface areas 45 and 47 are considered in terms of their maximum depth of cut areas or whether they are considered in terms of their effective cutting areas at some shallower cut, the relationships between them, as hereinafter described, will hold true.

The combined areas of the cutting surfaces 45 and 47 can be considered as the equivalent of the cutting surface area of a standard or conventional punch, i.e. the cutting surface area that would exist on the punch 25 if the first cutting portion 44 did not exist and the entire cutting surface was presented by an unobstructed cutting portion 46. The area of the cutting surface 45 is less than the combined area of the surfaces 45 and 47, but is a greater area than the cutting surface 47 of the second step cutting portion 46. This relationship between the cutting surfaces presents distinct advantages in the cutting operation.

By utilizing a first cutting portion of smaller than standard cutting area, that first portion 44 can provide a closer center line-to-center line cut than could a standard size punch. Furthermore, by making this reduced cutting area asymmetrical, rather than symmetrical as is standard practice in the art, the first cutting portion 44 can make the first cut on the key blank closely adjacent the shoulder of the key blank without mutilating or cutting away any portion of that shoulder. At the same time, by utilizing the two-step punch operation which will be described, the standard form of cut with standard lateral center line spacing can still be made in the key blank with the same punch, as required.

When standard cuts are to made in the key blank, a two-step shearing or punching sequence is effected. The punch is first advanced for penetration of the key blank by the first cutting portion 44. The entire compound force applied through the lever handle 37 is concentrated onto the small area of the cutting surface 45, so that a greater shearing or cutting pressure per unit area is applied to the key blank than would be the case if the larger cutting area of a conventional punch structure were used. Thereby, the force required for the initial shearing or cutting action on the key is reduced.

Further advancement of the punch brings the second cutting portion 46 into engagement with the key blank to complete a conventional form of cut. The area of the cutting surface 47 is even less than that of the cutting surface 45, so that an even lesser amount of force need be applied to the hand lever 37 to accomplish the second step of the cutting operation. By utilizing the two-step punch structure, a single actuating movement of the lever handle 37 effects a standard cut in the key blank with much less force than has heretofore been required.

In addition to the advantage immediately mentioned above, the two-step structure of the punch 25 also permits a flexibility of cutting operation which cannot be accomplished by a signle step cutting punch structure.

Figure 5:
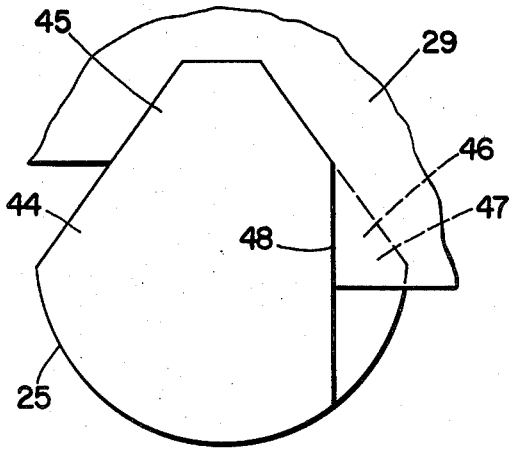
FIG. 5 is a schematic representation of the first cutting step utilizing the two-step punch.

In FIG. 5, there is schematically illustrated a track made by the first cutting portion 44 of the punch 25 as it advances through the key blank 29. The shoulder 48 of the key blank is shown adjacent the punch portion 44, so that FIG. 5 represents the first cut on the key. It will be noted that this cut is accomplished without cutting away any part of the shoulder 48. By reference to the dotted line of the trailing second cutting portion 46, showing its outline, it will be apparent that a standard punch structure would have cut through the shoulder 48.

Figure 6:
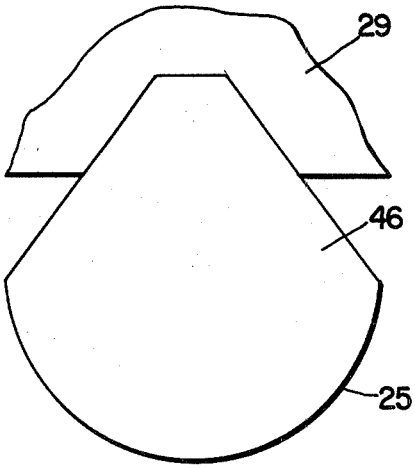
FIG. 6 is a schematic representation showing the second cut on the key blank utilizing the two-step punch.

FIG. 6 schematically illustrates a second or later cut of conventional form in the key blank 29. The initial cut was made by the first cutting portion 44, but as the punch 25 was advanced in the two-step operation, the second cutting portion 46 completed the cut by removal of key metal which had not been removed by the first cutting portion 44. It will be understood that the schematic illustrations of FIG. 5 and of FIG. 6 are representative of a single depth of cut, and that the support member 30 could position the key blank 29 for a shallower or deeper cut, as required.

In order to control the length of stroke of the punch 25 and prevent the cut of FIG. 6 from occurring when only the cut of FIG. 5 is desired, there is provided an adjustable punch-stop means for arresting the cutting movement of the punch 25 and limiting its stroke so that only the first cutting portion 44 of the punch is utilized in making the desired cut. Various forms of this punch-stop means are illustrated in FIGS. 7–11 of the drawing, to which reference will now be made.

Figure 7:
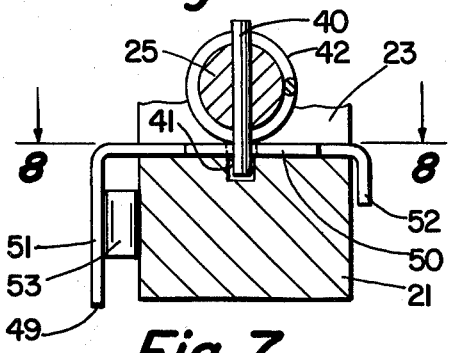
FIG. 7 is an enlarged cross-sectional view, taken as indicated on line 7—7 of FIG. 1, showing the punch-stop.
Figure 8:
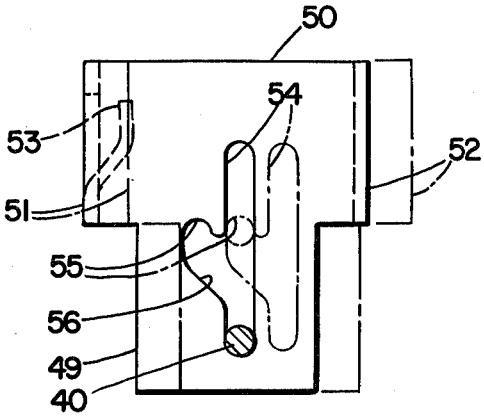
FIG. 8 is a top plan view showing further details of the punch-stop of FIG. 7 and a view in phantom outline of the operation of the punch-stop.

Referring to FIGS. 7–8, there is shown a somewhat U-shaped punch-stop element 49 having a central body portion 50 and downwardly depending, oppositely disposed flange portions 51 and 52. The central portion 50 rests on the flat upper surface of the body 21 of the key cutting device. The flanges 51 and 52 straddle the body 21 and limit lateral movement of the punch-stop 49 relative to the body 21. The central portion 50 sits slidably between the spaced upstanding portions 23 and 24 of the body 21, so that little or no longitudinal displacement of the element 49 is permitted. A portion 53 of the larger flange 51 can be slit and bent toward the body 21 to form an integral leaf spring which will bear against the side of the body 21 and resiliently urge the punch-stop element to a lateral position where the flange 52 abuts the opposite side of the body 21.

There is a longitudinally extending slot 54 provided in the central body portion 50. That slot is traversed by the pin 40 which extends diametrically through the punch 25. When the stop element 49 is in its normal spring-biased position, the slot 54 is aligned with the path of longitudinal travel of the punch 25 and its pin 40. The slot 54 is of sufficient length to permit full stroke of the punch in the two-step operation described, so that both the cutting portions 44 and 46 of the punch would be permitted to act upon the key blank 29.

Adjacent one side of the slot 54, a recess 55 is formed and provided with a camming edge or surface 56 which leads back into the slot 54. The recess 55 is off-set from the path of movement of the pin 40 when the stop element 49 is in its normal spring-biased position, so that the pin does not engage the recess. When the punch-stop element 49 is laterally displaced by a manual push on the flange 51, in opposition to the spring 53, the recess 55 is brought into the path of travel of the pin 40 on the punch 25. In operation, this is accomplished by manual pressure on the flange 51 as the punch is actuated, so that the recess 55 will be moved into the path of movement of the pin as the pin travels initially through the longitudinal slot 54 and comes into a position adjacent the recess 55. The pin then abuts the end of the recess and prevents further advancing movement of the punch to the end of its normal stroke. This abutment of the pin in the recess 55 is predetermined to occur at a point in the stroke of the punch where the first cutting portion 44 has penetrated the key blank 29, but the second cutting portion 46 has yet not operatively engaged the key blank. By this procedure, the cut made in the key blank is limited to the cut made by the first cutting portion 44 only.

As long as pressure on the lever handle 37 is maintained, the pin 40 will retain the punch-stop element 49 in its punch arresting position. When the lever handle is released, the punch and the pin 40 retract and, in doing so, the pin displaces the element 49 back to its original position through coaction of the rearwardly moving pin 40 on the camming edge 56 of the element 49. By reason of this camming displacement action of the pin 40, the use of a spring return, such as the described spring 53, for the punch-stop element is not mandatory and such a biasing spring could be omitted. However, the use of such a spring may be desirable to augment the mechanical camming displacement.

Figure 9:
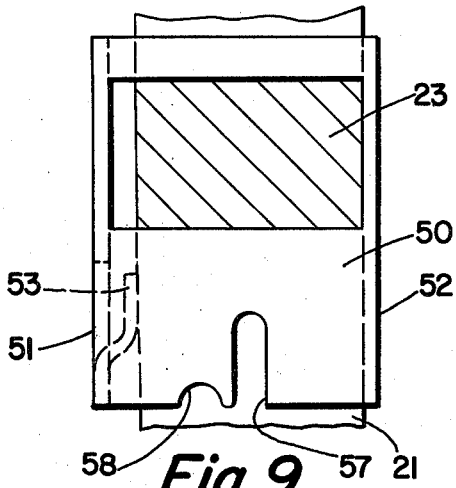
FIG. 9 is a view similar to FIG. 8, but showing a modified form of slot arrangement for the punch-stop.

FIG. 9 shows a modified form of slot and recess arrangement for the punch-stop element 49. In this form, both the longitudinal slot 57 and the abutment recess 58 are open-ended. The recess 58 further differs from the previously described recess 55 in not being provided with a camming edge. In other respects, the punch-stop element of FIG. 9 functions in the same manner as previously described. The slot 57 aligns with the pin 40 of the punch during full stroke movement of the punch. When the flange 51 is pushed to laterally displace the punch-stop element, the recess 58 becomes aligned with the path of movement of the pin 40 and limits the stroke of the punch to the desired first step cutting position only.

Figure 10:
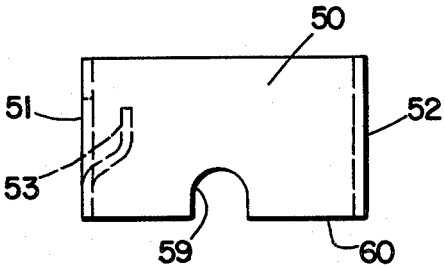
FIG. 10 is a view similar to FIG. 8, but showing another form of modified slot for the punch-stop.

In FIG. 10, another modified form of slot arrangement for the punch-stop element is shown. In this form, an open ended longitudinal slot 59 is provided for full stroke operation of the punch 25. When the punch-stop element is laterally displaced by pressure on the flange 51, the rearward edge 60 of the punch-stop element is disposed in the path of movement of the pin 40 which abuts that edge, thereby limiting the stroke of the punch to the operation of the first cutting portion 44 only.

In the modified forms of the punch-stop element shown in FIGS. 9 and 10, a return biasing spring 53 is utilized to retract the element to its normal position after the cut has been made. The forms of FIG. 9 and FIG. 10 have the advantage of permitting the punch-stop element to be laterally pushed into stroke-limiting position before the punch 25 is actuated, whereas in the form shown in FIGS. 7 and 8, there has to be some forward movement of the pin 40 before the punch-stop element can be pushed into stroke-limiting position.

Figure 11:
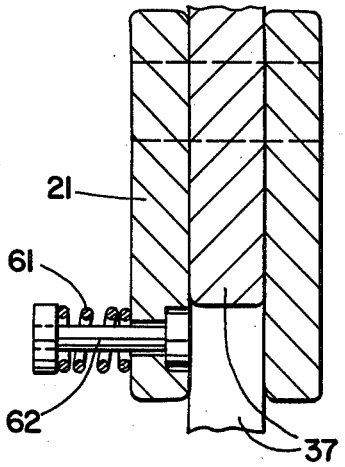
FIG. 11 is a fragmentary enlarged cross-sectional view showing still another form of punch-stop.

In FIG. 11 of the drawing there is shown another form of punch-stop arrangement 61 which utilizes a spring-biased pin 62 which is mounted for slidable movement in the side of the body 21 of the key cutting device. When the pin is depressed, it is projected into the path of movement of the lever handle 37 to correspondingly limit the stroke of the punch 25 to a position where only the first cutting portion 44 will act upon the key blank 29. When the pin 62 is not so depressed to traverse the body 21, it remains out of the path of movement of the lever handle 37, thus permitting full stroke two-step operation of the punch.

Figure 12:
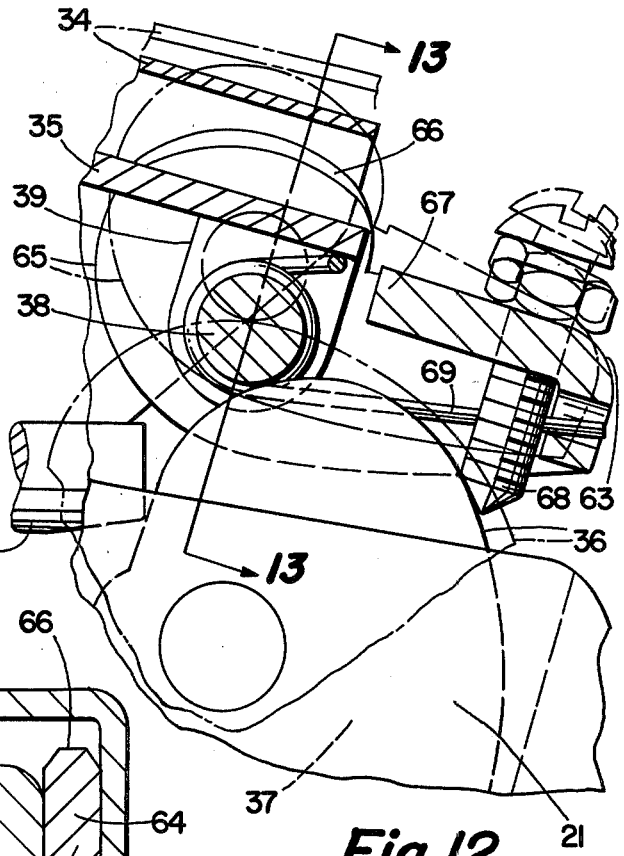
FIG. 12 is a fragmentary enlarged view in side elevation of the saddle control locking device of my invention in its unlocked position, with a phantom outline showing it in locked position.
Figure 13:
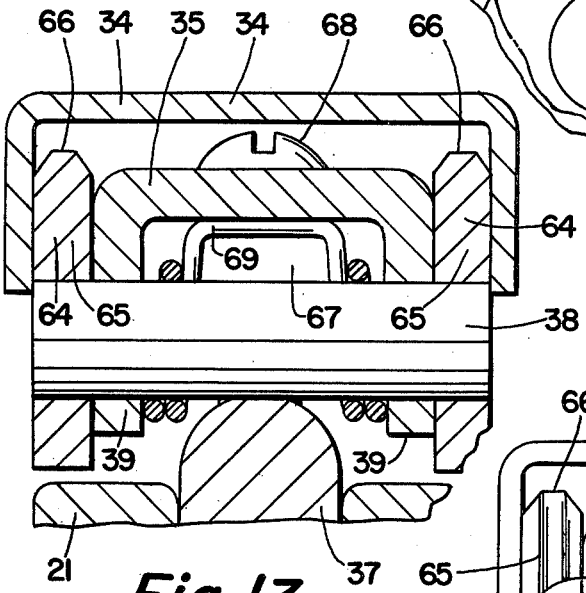
FIG. 13 is a cross-sectional view, taken as indicated on line 13—13 of FIG. 12.
Figure 14:
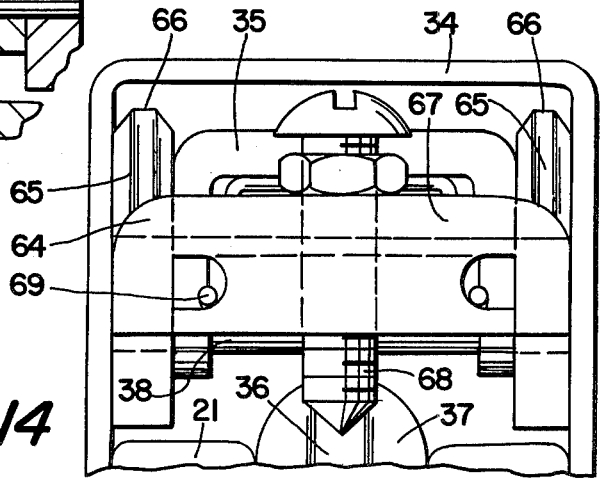
FIG. 14 is a fragmentary end view of the locking device, as viewed from the right side of FIG. 12.

Referring now to FIGS. 12–14 of the drawing, there is shown locking means 63 for automatically locking the key blank support member 30 against punch-induced displacement from the depth-gauge stop 33 during the cutting action.

The locking means consists of a saddle element 64 having spaced dependent ears 65 which are surmounted by spaced edge cams 66.

Rearwardly of the cams 66, the saddle element is provided with a body portion 67 in which is threadedly secured an adjustable abutment pin 68.

The saddle element 64 is pivotally mounted upon the ends of the previously described roller pin 38 so that the edge cams 66 straddle the end of the cantilever spring 35 and the body 67 extends rearwardly thereof so as to bring the pin 68 into abutment with the camming surface 36 of the lever handle 37. A torsion spring 69 encircles the roller pin 38 and has its ends disposed to resiliently maintain the pin 68 in abutment with the camming surface 36 during the initial actuating movement of the lever handle 37.

As the lever handle 37 is actuated to cam the roller pin 38 upwardly and lower the support member 30 into abutment with the stop 33 through the lost motion connection of the cantilever spring 35, the locking device 63 is also displaced upwardly and is caused to rotate about the roller pin axis 38 by spring 69 to bring the edge cams 66 into locking abutment with the underside of the rocker arm or saddle element 34 as the lost motion movement continues. At this point in the operation, the cam surface 36 of the handle recedes and no longer engages or has to engage the adjusting pin 68, as the edge cams 66 are fixed in locking position to brace the saddle element 34 against displacement.

After the lever handle 37 is released, the cam surface 36 re-engages pin 68 to cause reverse pivotal movement of the locking device 63 and release the edge cams 66 from locking engagement with saddle element 34.

By utilizing the described form of locking means, precision and accuracy of depth of cut can be repetitively maintained even under circumstances where the punch becomes dull or the key material is exceptionally hard or the cantilever spring 35 has weakened or become fatigued. By means of the two-step punch, greater shearing force per unit area is achieved for easier key cutting and versatility of the cuts can be accomplished without the necessity of frequent changes of the cutting tool.

It is to be understood that the forms of my invention, herewith shown and described, are to be taken as preferred examples of the same and that various changes in the shape, size and arrangement of the parts may be resorted to without departing from the spirit of the invention or the scope of the subjoined claims.

I claim:

1. In a key cutting device having a body, a movable cutting tool carried by said body, a key blank support member yieldably mounted on said body and selectively movable to bring the key blank into and out of the path of cutting movement of said cutting tool, depth-of-cut gauging means carried by said body in the path of movement of said support member, and actuating means for effecting operative movement of said cutting tool and said support member: the improvement comprising a cutting tool in the form of a longitudinally movable key shearing punch, said punch presenting a first cutting portion at its forward cutting end and an enlarged second cutting portion rearwardly of said first cutting portion, and adjustable punch-stop means carried by said body and selectively movable to arrest forward cutting movement of said punch before said enlarged second portion reaches operative cutting position.

2. An improvement as defined in claim 1, including means, responsive to actuation of said punch, for locking said yieldable support member against displacement from operative engagement with said depth-of-cut gauging means.

3. In a key cutting device having a body, a movable cutting tool carried by said body, a key blank support member yieldably mounted on said body and movable to bring the key blank into and out of the path of cutting movement of said cutting tool, depth-of-cut gauging means carried by said body in the path of movement of said support member, and actuating means for effecting operative movement of said cutting tool and said support member: the improvement comprising locking means responsive to actuation of said cutting tool for securing said yieldable support member against displacement from operative engagement with said depth-of-cut gauging means.

4. An improvement as defined in claim 3, wherein said cutting tool is in the form of a longitudinally movable shearing punch which engages the key blank to impose forces on said support member in opposition to said locking means.

5. An improvement as defined in claims 1 or 2, wherein said punch is provided with a circumferentially-extending projection, and said punch-stop means is selectively movable into the path of movement of said projection to arrest cutting movement of said punch at a predetermined position.

6. An improvement as defined in claim 5, wherein said punch-stop means presents an abutment to continued forward movement of said punch when said punch-stop means is moved into punch-arresting position.

7. An improvement as defined in claim 5, including resilient means biasing said punch-stop means out of engagement with said projection.

8. An improvement as defined in claim 5, including a slot provided in said punch-stop means, said slot defining a recess for abutment with said projection when said punch-stop means is moved into punch-arresting position, and a camming surface provided in said recess and engageable upon retractive movement of said punch to displace said punch-stop means to its non-operative position.

9. An improvement as defined in claims 1 or 2, including a pivotal hand lever for actuating said cutting tool and support member, and said adjustable punch-stop means is selectively movable into the path of actuating movement of said hand lever.

10. An improvement as defined in claims 3 or 4 including a rocker arm pivotally connected to said body, one end of said rocker arm engaging said support member, an actuating lever pivotally secured to said body and engaging a rearward end of said cutting tool, first resilient means operatively interconnecting said lever and said rocker arm, second resilient means biasing said lever to a non-actuating position, whereby pivotal movement of said lever effects operative movement of said cutting tool and said support member, and said locking means comprises a pivotally mounted camming member engaging said lever and rotatable in response to actuating movement of said lever, said camming member being engageable with said rocker arm to secure it in opposition to said first resilient means when said support member has been moved into abutment with said depth-of-cut gauging means in response to actuating movement of said lever.

11. An improvement as defined in claim 10, including a camming surface provided on said lever and engaging said locking means to effect movement thereof.

12. An improvement as defined in claim 10, including third resilient means engaging and biasing said locking means to inoperative position upon retraction of said lever.

13. An improvement as defined in claim 10, including adjusting means carried by said locking means and engaging said lever, said adjusting means being selectively movable to vary the extent of lever-responsive pivotal movement of said camming member.

* * * * *